United States Patent [19]

Stricklin

[11] 4,102,130

[45] Jul. 25, 1978

[54] CONVERTING AN INTERNAL COMBUSTION ENGINE TO A SINGLE ACTING ENGINE DRIVEN BY STEAM OR COMPRESSED AIR

[76] Inventor: Harry Charles Stricklin, 2004 E. 224th St., Euclid, Ohio 44117

[21] Appl. No.: 668,749

[22] Filed: Apr. 19, 1976

Related U.S. Application Data

[63] Continuation of Ser. No. 455,921, Mar. 28, 1974, abandoned.

[51] Int. Cl.[2] ..... F01L 13/02; F01B 23/02

[52] U.S. Cl. ..... 60/407; 60/370; 60/721; 123/1 R

[58] Field of Search ..... 60/712, 721, 407, 412, 60/670, 651, 671, 370, 413; 123/21, 1 R; 180/66, 54

[56] References Cited

U.S. PATENT DOCUMENTS

| | | | |
|---|---|---|---|
| 807,835 | 12/1905 | Lyon | 60/712 |
| 808,210 | 12/1905 | Palmbla | 123/21 |
| 1,007,278 | 10/1911 | Dyer | 123/21 |
| 1,036,321 | 8/1912 | Pembroke | 123/21 |
| 1,792,028 | 2/1931 | Peterson | 123/21 |
| 2,001,577 | 5/1935 | Johnson | 60/712 |
| 3,765,180 | 10/1973 | Brown | 60/370 |
| 3,867,816 | 2/1975 | Barrett | 60/682 |
| 3,885,387 | 5/1975 | Simington | 60/412 |
| 3,987,633 | 10/1976 | Ford, Jr. | 60/671 |

*Primary Examiner*—Allen M. Ostrager
*Attorney, Agent, or Firm*—John Harrow Leonard

[57] ABSTRACT

The method converts a conventional four cycle internal combustion engine into a single acting reversible steam, or fluid pressure, operated engine by changing the timing cycle of the valves relative to the crankshaft and connecting the valve ports to a reversing valve for admitting live steam to the intake ports while connecting the exhaust ports to the atmosphere, and for reversing the connection, selectively.

3 Claims, 7 Drawing Figures

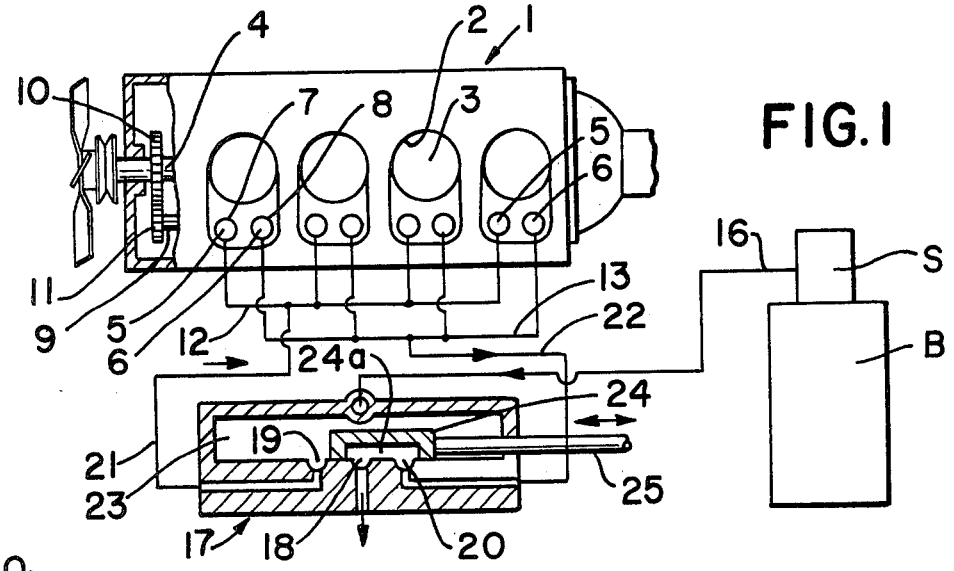
FIG. 1
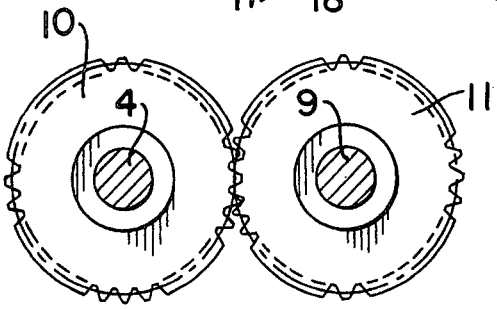
FIG. 2
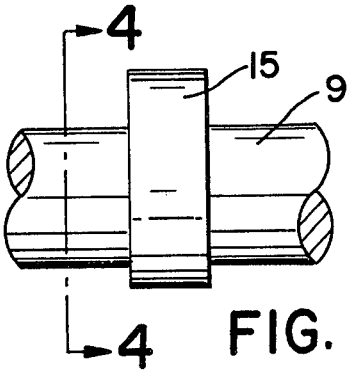
FIG. 3
FIG. 4
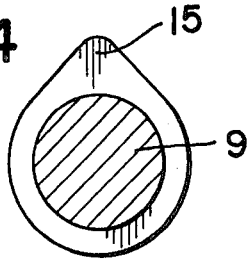
FIG. 5
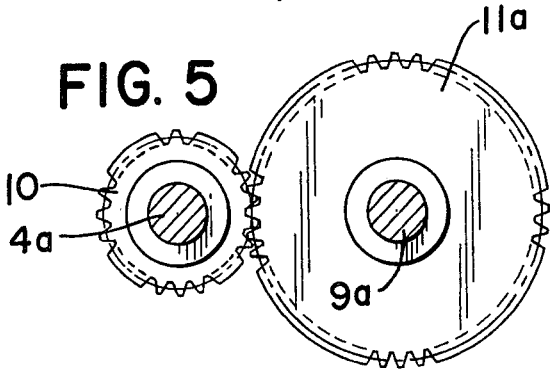
FIG. 6
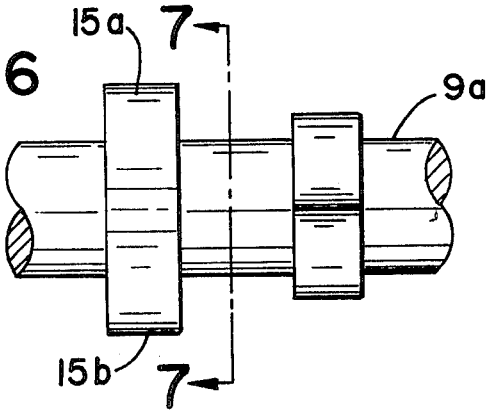
FIG. 7
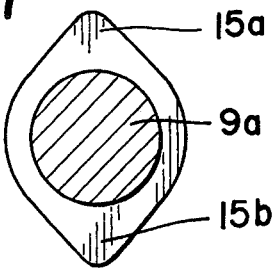

CONVERTING AN INTERNAL COMBUSTION ENGINE TO A SINGLE ACTING ENGINE DRIVEN BY STEAM OR COMPRESSED AIR

This is a continuation of application Ser. No. 455,921, filed Mar. 28, 1974 now abandoned.

BACKGROUND OF INVENTION (1) Field of Invention

Conversion of a four cycle internal combustion engine into a single acting reversible, two cycle, steam engine.

(2) Description of Prior Art

Heretofore internal combustion gasoline engines have been provided which can be started rotating by introduction of compressed air, and then shifted to internal combustion operation. Other internal combustion engines have been converted for operation by fluid pressure supplied to the cylinders through the spark plug openings in timed relation to engine speed effected by a common rotary valve driven in timed relation to engine speed effected by a common rotary valve driven in timed relation to the engine speed. In this type of conversion, the original intake valves, or their ports, are permanently closed.

Other compressed air engines have been fabricated, using a multi-cylinder, four cycle internal combustion engine block as the block for a four cycle compressor.

Still other engines operate on the Carnot cycle.

SUMMARY

The present method is for converting a conventional four cycle internal combustion engine into a reversible single acting steam engine by simple changes in the valve timing cycle while retaining intact and utilizing the basic engine structure such as the intake and exhaust valves and ports, pistons, cylinders, crankshaft, and cam shaft. All of the conventional accessories needed for the internal combustion engine operation specifically may be omitted or removed. These include such things as the starter, carburetor, air filter, spark plugs, wiring and distribution system, cooling fan, water pump, transmission and, if desired, the clutch. The spark plug openings are sealed, either by the spark plugs or other plugs. The timing relation of the exhaust valves and intake valves is changed so that each functions as before in relation to the position of its associated piston, but each valve functions once for each revolution of the engine crankshaft instead of once for each two revolutions thereof. This change in timing is effected by either (a) changing the timing gear train to effect a one revolution of the valve operating cam shaft to one revolution of the crankshaft, instead of one revolution of the cam shaft to two revolutions of the crankshaft, or (b) retaining the usual two to one revolutions of the crankshaft to the cam shaft while retaining and using the original cams on the cam shaft, but providing, at the location of each original cam, a duplicate cam spaced 180° about the cam shaft axis from the original cam.

All inlet ports are connected at their inlet sides to a common manifold, and all exhaust ports are connected at their outlet sides to a different manifold common to all of them. The manifolds are connected to a manually settable reversing valve through which live steam is supplied from a boiler. The valve can be set selectively to connect one manifold for receiving live steam and concurrently connecting the other manifold to exhaust, and for reversing the connection.

DESCRIPTION OF THE DRAWINGS

FIG. 1 is a diagrammatic top plan view of a conventional four cycle internal combustion engine, modified in accordance with the present method, and connected to a suitable source of steam through a conventional reversing valve;

FIG. 2 is a diagrammatic end elevation illustrating the modification of the driving gear train for converting the engine of FIG. 1 to a reversible two cycle steam engine;

FIG. 3 is a fragmentary enlarged side elevation of a portion of the cam shaft of the engine illustrated in FIG. 1;

FIG. 4 is a fragmentary cross sectional view of the structure illustrated in FIG. 3;

FIG. 5 is a diagrammatic end elevation of the gear train as originally used in the engine in FIG. 1, when it was used as an internal combustion engine;

FIG. 6 is a fragmentary side elevation of a cam shaft modified for performing the method of the present invention with the original gear train of FIG. 5; and FIG. 7 is a fragmentary sectional view taken on the line 7—7 of FIG. 6.

Various specific objects and advantages of the invention will become apparent from the following description of a preferred embodiment of the invention.

PREFERRED EMBODIMENT OF THE INVENTION

Referring to the drawings, the invention is disclosed as applied to a conventional four cycle internal combustion engine 1, having cylinders 2 in which pistons 3 are reciprocable for driving a crankshaft 4. Each cylinder is provided with an intake poppet valve 5 and exhaust poppet valve 6. The intake valves 5 control intake ports 7 and the exhaust valves control exhaust ports 8. The valves are driven in timed relation to the positions of their associated pistons by a common cam shaft 9, which, in turn, is driven, through a gear train, by the crankshaft 4. As illustrated, the gear train comprises a driving gear 10 on, and driven by, the crankshaft 4, and a complementary driven gear 11 on, and driving, the cam shaft 9, and driven by the gear 10. The intake ports 7 are connected to a common manifold 12 and the exhaust ports 8 are connected to a common manifold 13.

The structure above described is that of a conventional four cylinder internal combustion gasoline engine, except for the new relation of the driving gear 10 on the crankshaft 4 and driven gear 11 on the cam shaft 9, which is best described by reference to FIGS. 2 through 4.

The internal combustion operation of the engine normally would be in a ratio of one revolution of the cam shaft 9 to two revolutions of the crankshaft 4. For example, as illustrated in FIG. 5, to which reference is made hereinafter, originally the driving gear, indicated at 10*a*, would be half the diameter of the driven gear 11*a*. However, in the first embodiment of my invention, as illustrated in FIGS. 2 through 4, this driving relation is changed and the driving gear 10 and driven gear 11 are the same, so that the cam shaft 9 is driven through one revolution for each revolution of the crankshaft 4.

The cam shaft 9 retains its original conventional cam 15, but since the cam shaft 9 is driven one revolution for each revolution of the crankshaft 4, each valve is opened by its associated cam 15 once each revolution of the crankshaft 4, instead of once for each two revolutions of the crankshaft 4. The cams 15, arranged one for each valve, are retained in their conventional positions and are the same as in the original engine, and thus each cam drives its valve to open and closed positions in the same relation to the position of its associated piston as in the original engine. With this change in the gear train, the engine can be driven in one direction by introducing live steam through either selected one of the manifolds while venting the other manifold to exhaust, and it can be reversed by reversing the connections of the manifolds, respectively, to a source of live steam and exhaust.

As illustrated in FIG. 1, regardless of the type of conversion, steam is supplied by a suitable boiler B, which may be provided with a super-heater S, from which live steam is supplied through a line 16 to a reversing valve indicated generally at 17. The reversing valve has an exhaust port 18 and steam supply ports 19 and 20, respectively. The port 19 is connected by a line 21 to the manifold 12 and the port 20 is connected by a line 22 to the manifold 13. The reversing valve has a conventional live steam chest 23 in which the supply ports 19 and 20 open so that a supply of live steam can be admitted to them. The admission and exhaust of steam is controlled by a suitable slide 24, driven manually by an externally extending rod or lever 25. The slide 24 is arranged so that in one position, such as illustrated in FIG. 1, it uncovers the port 19, thus admitting live steam through the line 21 to the manifold 12. Concurrently, through an internal cavity **24*a* in the slide 24, it connects the port 20 with the exhaust port 18. Thus live steam is supplied through the line 21 to the manifold 12 and spent steam is exhausted from the manifold 13 by way of the line 22 and exhaust passage 18. By shifting the slide to the left it can be positioned so that it connects the port 19 to the exhaust port 18 through the cavity 24*a* while blocking the exhaust from the port 20 and connecting it to the live steam chest 23, thus reversing the operation and supplying live steam to the manifold 13 through the line 22 and exhausting the steam from the cylinders through the manifold 12 and line 21**.

Generally, in such reversing valves, the slide 24 is of sufficient length and its controlling lands are of proper size so that the amount of live steam admitted to either manifold can be varied without changing the exhaust capacity, thereby to vary the speed of the engine in the selected direction of rotation.

In converting the engine for steam operation, the spark plug openings are sealed either by the spark plugs themselves or by removing the plugs and installing permanent plugs in the openings therefor.

Thus, by this simple method, the four cycle internal combustion engine is converted to a single acting reversible steam engine, utilizing the original cylinders, pistons, intake and exhaust valves, crankshaft and cam shaft, and eliminating the conventional wiring equipment originally necessitated for carburization and detonation of the fuel in internal combustion engines, and eliminating the usual starter, fan, cooling system and the like.

A modification of the method, as illustrated in FIG. 5, is to retain the original driving gear train in which the driving gear on the crankshaft is indicated at **10*a* and the driven gear on the cam shaft is indicated at 11*a*. When these are retained, then the cam shaft, indicated at 9*a*, is retained also, but instead of the single cam 15*a*, comparable to cam 15, heretofore described, a duplicate cam 15*b* is added to the shaft, one cam 15*b* opposite from each cam 15*a*, and spaced therefrom 180° about the cam shaft axis. Thus, though the shaft 9*a* rotates only once for each two revolutions of the crankshaft, nevertheless, due to the additional or supplemental conversion cam 15*b*, each valve is operated twice for each revolution of the cam shaft 9*a***, instead of once as heretofore described, and thus each valve is operated once for each revolution of the crankshaft.

The result in the first described method is essentially the same as in the modified method. In each instance, the conversion effected is converting the four cycle internal combustion engine into a single acting reversible steam engine.

The engine, regardless of which method is used, is such that just as each piston passes top dead center, the associated intake valve is opened to admit live steam which drives the piston toward bottom dead center. As the piston approaches bottom dead center, the associated intake valve is closed. As the piston passes bottom dead center, the associated exhaust valve opens and the spent steam is exhausted from the cylinder as the piston returns to top dead center. Just before the piston reaches top dead center, the exhaust valve closes, and as the piston passes top dead center, the intake valve is again opened. This is true for each cylinder if the original engine is more than one cylinder. As a result, each cylinder completes two working strokes in the same number of revolutions of the crankshaft in which only one was produced when the engine operated originally as an internal combustion engine.

Generally, the boiler should be one rated at about 1500° F. working temperature. If desired, a generator driven by the engine and heating elements connected thereto may be provided and cut in when the engine is idling for the purpose of assisting in maintaining steam boiler pressure. The boiler should be of suitable size and shape to provide sufficient water capacity to generate the steam required and to withstand 2000 pounds per square inch of steam pressure. The heating and steam producing elements of the boiler, not shown, may be controlled by conventional thermostats or pressure regulators, necessary operating relays, and the like. The boiler, of course, should be equipped with the usual inlet and outlet fittings, pressure gauges, water level indicators and the like.

If desired, the spent steam from the exhaust of the reversing valve may be passed through a conventional steam oil trap and to a radiator type condenser where the spent steam is condensed to water. This condensation may be passed from the condenser through a suitable water trap which vents any excess steam to the atmosphere while the water is piped back to a conventional water supply for reuse. The water may be passed from the water supply tank to the water jacket of the engine to an injection pump which draws water from the water supply tank and forces it into the boiler through a by-pass valve in the conventional manner which is controlled by the water lever indicating means on the boiler. The injector pump may be driven by any suitable power take-off from the engine. In its broader aspects, the present method is not limited to one particular type of four cycle internal combustion engine. Although the preferred embodiments of the present invention have been described in detail, it is apparent that modification thereof may be made without departing from the spirit of the improvement as defined in the appended claims.

While the engine is shown as operated by steam it could, of course, be operated by any pressurized fluid in which case the boiler B would be replaced by any suitable source of fluid under working pressure. Further, while a four cylinder gasoline four cycle engine is shown for illustration, the method is applicable to both single cylinder and multi-cylinder four cycle engines.

Having thus described my invention, I claim -

1. A method of converting to a single acting, reversible steam engine a four cycle internal combustion engine which includes an engine block, a cylinder therein having an intake port and an exhaust port, an inlet valve and an exhaust valve for said ports, respectively, a piston reciprocable in the cylinder, a crankshaft driven by the piston, a cam shaft, timing gears interconnecting the crankshaft and cam shaft so that the cam shaft is driven by the crankshaft in a ratio of one revolution of the cam shaft to two revolutions of the crankshaft, cams on said cam shaft for the valves, respectively, and arranged one cam for each valve for lifting and lowering the associated valve so as to open and close its associated port in and for a four cycle operation of the engine;

said method comprising:

changing the relation of the camming action on said valves by said cam shaft in relation to the rotation of the crankshaft to cause each of said valves to open and close in substantially the original relation to piston position once per revolution of the crankshaft; then arranging for continuous introduction of high pressure fluid to the entrance side of said intake port and controlling its passage through said intake port by said inlet valve and for continuous delivery of fluid from the cylinder to the inlet side of the exhaust port and venting of fluid from the outlet side of the exhaust port and controlling the venting through the exhaust port by said exhaust valve, to effect driving of the engine in one direction; and arranging for manually selectively reversing the introduction and venting of said high pressure fluid to said ports in a manner to effect continuous introduction of the high pressure fluid to the outlet side of the said exhaust port and the continuous venting of the entrance side of the said inlet port, thereby to cause driving of the engine in a direction which is the reverse of said one direction.

2. The method according to claim 1 wherein said changing of the camming action is effected by changing said timing gears to a ratio which causes the cam shaft to be driven by the crankshaft in a one to one relation of revolutions.

3. The method according to claim 1 wherein said changing of the camming action is effected by providing the cam shaft with two substantially duplicate cams, spaced apart from each other 180° about the axis of the cam shaft, for each valve.

* * * * *